US011339610B2

(12) United States Patent
Magro

(10) Patent No.: US 11,339,610 B2
(45) Date of Patent: May 24, 2022

(54) AUXILIARY CHAIN ASSEMBLY FOR ROLLING DOORS AND THE LIKE

(71) Applicant: ALPINE OVERHEAD DOORS, INC., East Setauket, NY (US)

(72) Inventor: Sebastian Magro, Stony Brook, NY (US)

(73) Assignee: ALPINE OVERHEAD DOORS, INC., East Setauket, NY (US)

( * ) Notice: Subject to any disclaimer, the term of this patent is extended or adjusted under 35 U.S.C. 154(b) by 73 days.

(21) Appl. No.: 16/584,330

(22) Filed: Sep. 26, 2019

(65) Prior Publication Data

US 2021/0095523 A1 Apr. 1, 2021

(51) Int. Cl.

| | |
|---|---|
| ***E06B 9/84*** | (2006.01) |
| ***E06B 9/15*** | (2006.01) |
| ***E06B 9/174*** | (2006.01) |
| ***E06B 9/78*** | (2006.01) |
| *E06B 9/80* | (2006.01) |

(52) U.S. Cl.

CPC ..... *E06B 9/84* (2013.01); *E06B 9/15* (2013.01); *E06B 9/174* (2013.01); *E06B 9/78* (2013.01); *E06B 2009/807* (2013.01)

(58) Field of Classification Search

CPC ..... E06B 9/84; E06B 9/78; E06B 2009/807; E06B 9/15; E06B 9/174; E06B 9/17; E06B 9/82; E06B 9/90; E06B 9/74; E06B 9/80; E06B 2009/802; B66D 3/16; B66D 3/12; E05F 11/04; E05F 2005/043; E05Y 2201/678; E05D 13/003; F16H 55/303

USPC ..... 49/322

See application file for complete search history.

(56) References Cited

U.S. PATENT DOCUMENTS

| | | | | | |
|---|---|---|---|---|---|
| 1,862,331 | A | | 6/1932 | Coffing | |
| 1,937,331 | A | | 11/1933 | Coffing | |
| 1,973,844 | A | | 9/1934 | Coffing | |
| 2,044,565 | A | | 6/1936 | Coffing | |
| 2,150,419 | A | | 3/1939 | Coffing | |
| 2,269,438 | A | | 1/1942 | Coffing | |
| 3,110,199 | A | | 11/1963 | Lilly | |
| 3,637,004 | A | * | 1/1972 | Wardlaw | E06B 9/84 160/133 |
| 4,520,998 | A | | 6/1985 | Flaig | |
| 4,664,170 | A | * | 5/1987 | Labelle | A62C 2/16 160/133 |
| 5,127,631 | A | | 7/1992 | Flaig | |

(Continued)

*Primary Examiner* — Johnnie A. Shablack
*Assistant Examiner* — Jeremy C Ramsey
(74) *Attorney, Agent, or Firm* — Nolte Lackenbach Siegel; Myron Greenspan

(57) ABSTRACT

A chain assembly includes a wheel secured on a shaft. A chain manually rotates the wheel and the shaft. A one way bearing has an inner race secured to the shaft and has an outer race that can freely rotate in only one direction in relation to the inner race. A brake drum is coupled to the outer race. Brake shoes are in operative contact with the brake drum to apply friction to the brake drum when there is relative motion between them. A brake adjuster adjusts the braking force applied by the brake shoes on said brake drum. The one way bearing is arranged to maintain the brake drum stationary in one direction of rotation of the shaft and rotate the brake drum in the opposite direction of rotation resulting in a degree of braking of the shaft as determined by the brake adjuster.

20 Claims, 11 Drawing Sheets

(56) References Cited

U.S. PATENT DOCUMENTS

| | | | | |
|---|---|---|---|---|
| 5,351,906 | A | 10/1994 | Feathers | |
| 5,893,234 | A * | 4/1999 | McKeon | E06B 9/68 49/30 |
| 8,069,896 | B2 * | 12/2011 | Magro | E06B 9/72 160/1 |
| 8,230,759 | B2 * | 7/2012 | Hsieh | E05D 13/003 74/625 |
| 8,511,434 | B2 | 8/2013 | Blomberg | |
| 10,196,822 | B2 * | 2/2019 | Deutsch | E05F 11/04 |
| 2003/0197160 | A1 * | 10/2003 | Curtis | E06B 9/78 254/358 |
| 2017/0089134 | A1 * | 3/2017 | Hsieh | F16D 51/32 |

* cited by examiner

SECTION A-A

CUT-AWAY DETAIL B
FLY LOCKOUT PIN IN
UNLOCK POSITION

DETAIL C
FLY LOCKOUT PIN
IN LOCKED POSITION

AUXILIARY CHAIN ASSEMBLY FOR ROLLING DOORS AND THE LIKE

BACKGROUND OF THE INVENTION

1. Field of the Invention

The present invention generally relates to the chain hoisting assemblies and, specifically to auxiliary chain assemblies for rolling doors and the like.

2. Description of the Prior Art

Protection and safety devices are important components of numerous mechanical machines and systems, particularly when heavy objects are being lifted. Rolling doors fall into this category as they can be extremely heavy and when there is a mechanical or electrical failure a rolling door can fall precipitously causing potential injury and damage to property. Numerous hoists are described, for example, in the following patents: U.S. Pat. Nos. 1,862,331; 1,937,331; 1,973,844; 2,044,565; 2,150,419; 2,269,438; 4,520,998; 5,127,631; 5,351,906 and 8,511,434. However, the hoist mechanisms are primarily designed to lift heavy objects and provide various levels of protection when failure occurs or when a user inadvertently or accidently releases a chain, cable or the like used to raise the object. Many of the designs described in the above enumerated patents are complicated and can be costly and not particularly suited for use with rolling doors.

SUMMARY OF THE INVENTION

Accordingly, it is an object of the invention to provide an auxiliary chain assembly that overcomes disadvantages in prior art hoist and chain assemblies.

It is another object of the invention to provide an auxiliary chain assembly that is simple in construction and economical to manufacture.

It is still another object of the invention to provide an auxiliary chain assembly that is well suited and can easily be incorporated for use with rolling doors.

It is yet another object of the invention to provide a rolling door with auxiliary chain assembly that enables the rolling door to be lifted manually while provides protection for controlled lowering of the rolling door when there is inadvertent release of the chain.

It is a further object of the invention to provide an auxiliary chain assembly that is easy to operate.

It is still a further object of the invention to provide an auxiliary chain assembly that provides automatic, quick and reliable braking when there is a failure that enables the rolling door to drop precipitately under its own weight.

It is still a further object of the invention to provide an auxiliary chain assembly as above suggested that enables simple and efficient raising as well as lowering of a rolling door.

In order to achieve the above as well as other objects a chain assembly comprises a shaft; a wheel secured to said shaft; a hand-operated means for rotating said wheel and said shaft about an axis; a one way bearing having an inner race secured to said shaft for rotation therewith and having an outer race that can freely rotate in one direction in relation to said inner race and prevented from freely rotating in another or opposite direction in relation to said inner race; a brake drum coupled to said outer race; brake shoe means arranged to be in operative contact with said brake drum to apply frictional forces to said brake drum when there is relative motion between said brake shoe means and said brake drum; brake adjusting means for adjusting the braking forces applied by said brake shoe means on said brake drum, said one way bearing being arranged to maintain said brake drum stationary in one direction of rotation of said shaft and to rotate said brake drum in the opposite direction of rotation of said shaft resulting in a degree of braking of said shaft as determined by said brake adjusting means.

BRIEF DESCRIPTION OF THE DRAWINGS

Those skilled in the art will appreciate the improvements and advantages that derive from the present invention upon reading the following detailed description, claims, and drawings, in which:

DESCRIPTION OF PREFERRED EMBODIMENT

Figure 1:
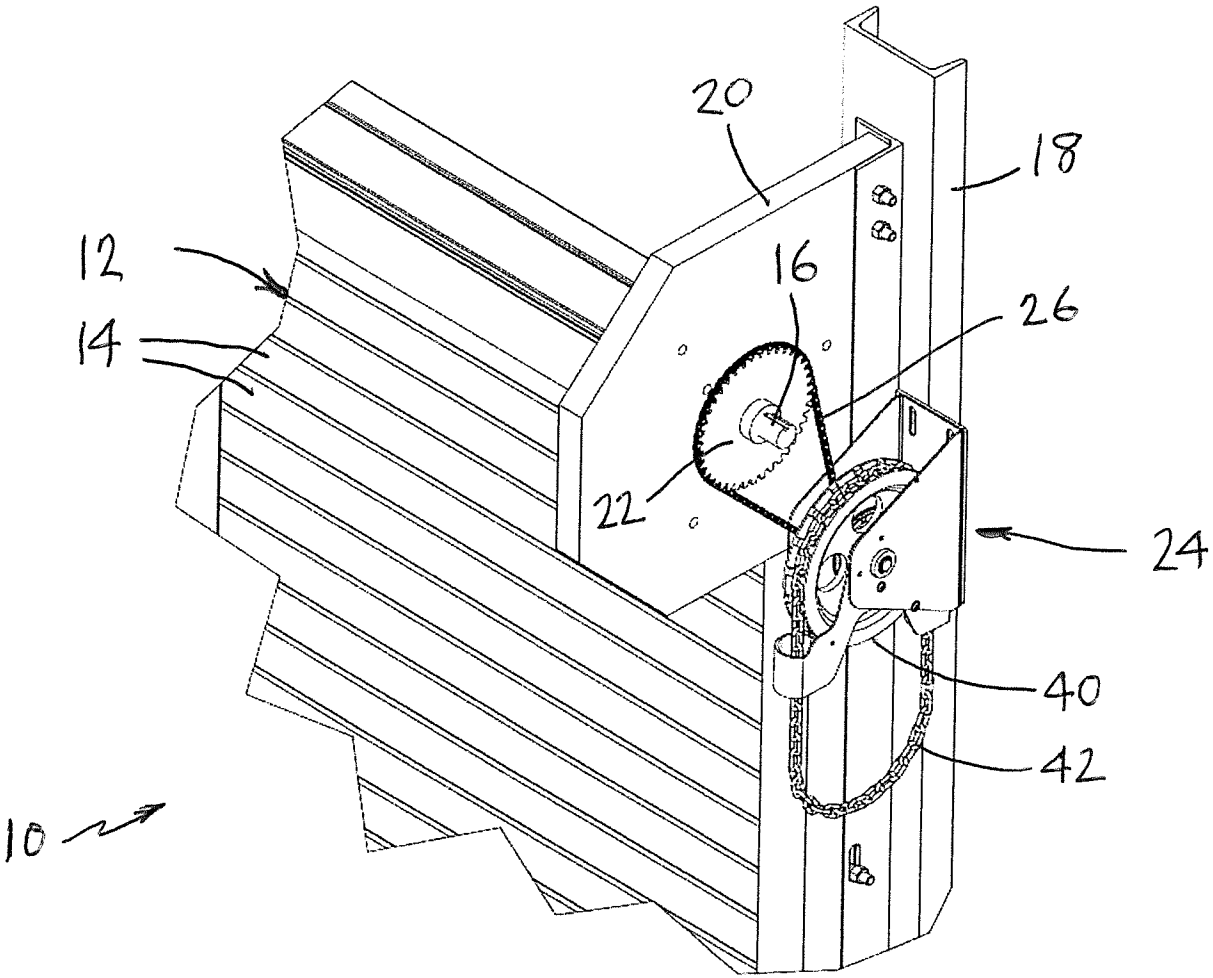
FIG. 1 is a fragmented perspective view of a rolling door assembly coupled to an auxiliary chain assembly in accordance with the invention.
Figure 2:
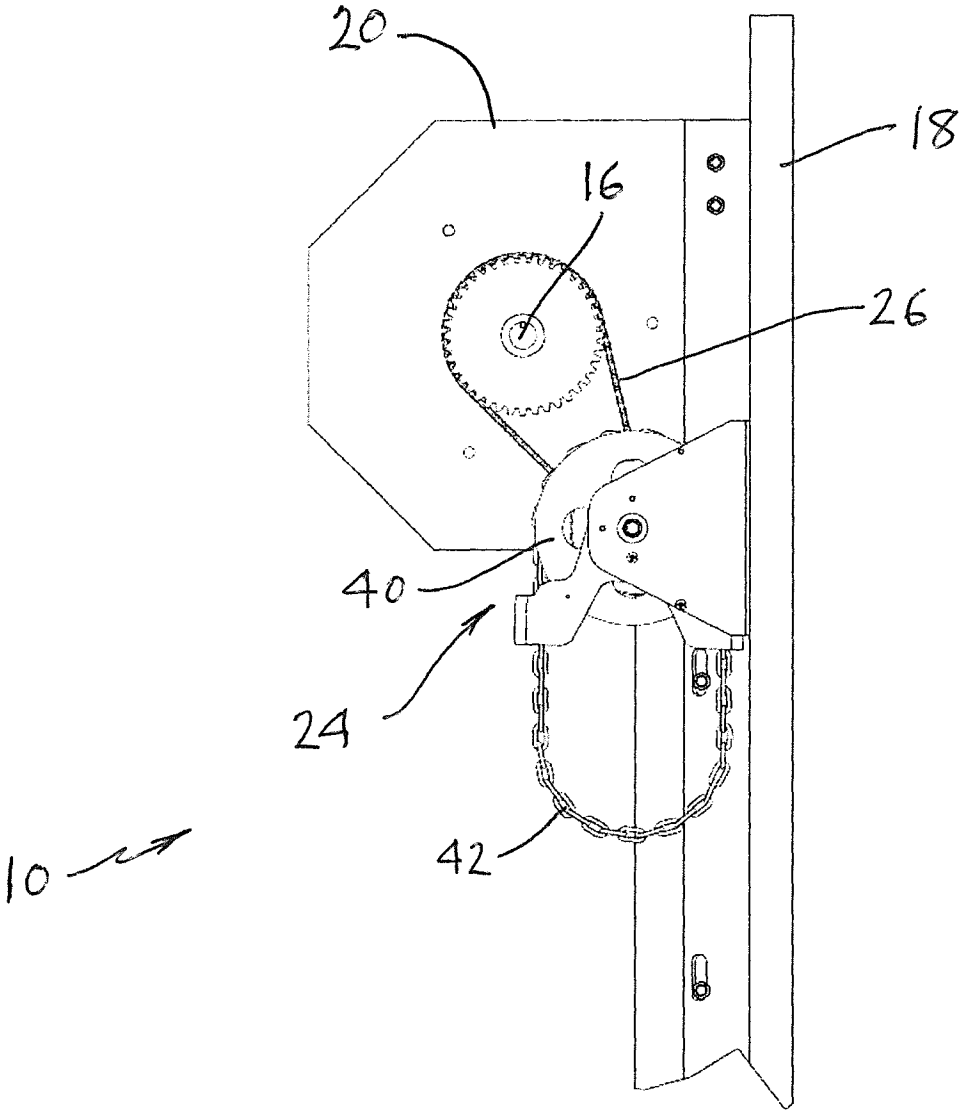
FIG. 2 is a side elevational view of the rolling door assembly shown in FIG. 1.

Referring now specifically to the figures, in which the identical or similar parts have been designated by the same reference numerals throughout, and first referring to FIGS. 1 and 2, a rolling door assembly is generally designated by the reference numeral 10.

The rolling door assembly 10 includes a rolling door or curtain 12 formed of horizontal slats 14 linked to each other in any conventional manner as shown. The slats 14 and, therefore, the curtain 12, are generally formed of steel and can represent a significant weight. The curtain 12 can be rolled up about a main horizontal shaft 16 between a fully raised condition to provide access to an entry point in a structure and a fully lowered position to close such opening or entry point. The edges of the slats 14 are received and generally slide within vertical tracks or rails 18 in any conventional manner. The curtain 12 is typically raised and lowered by an operator that includes a reversible motor drive for rotating the shaft 16 in either direction about its axis. The operator and motor drive therein are not shown in FIGS. 1 and 2 and any conventional operators may be used with the subject invention.

An auxiliary chain assembly 24 in accordance with the invention is coupled with a gear 22 mounted on the main shaft 16, the gear 16 being coupled to the auxiliary chain assembly as to be more fully described.

The auxiliary chain assembly 24 is coupled to the gear 22 by means of a chain 26, the gears being selected to generally provide a desired gearing ratio, as well understood to those skilled in the art.

Figure 3:
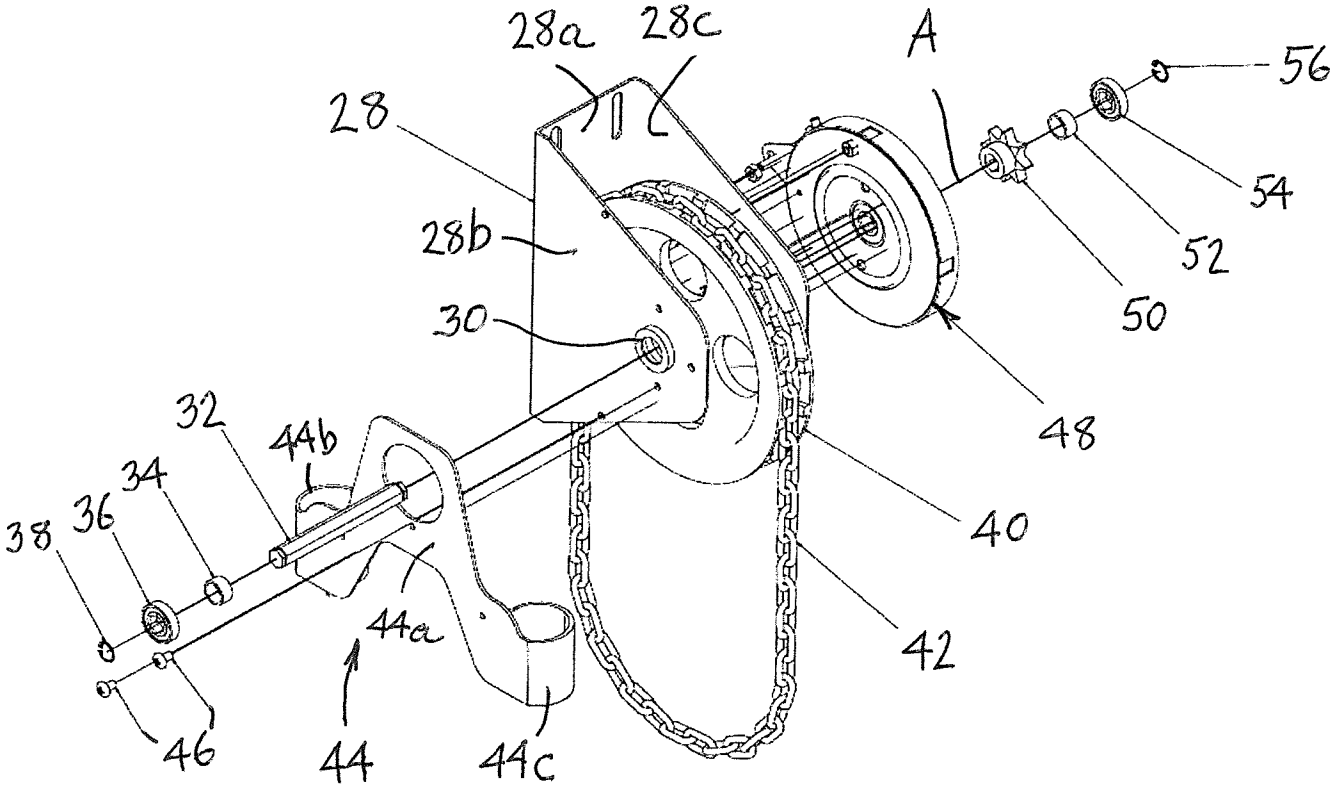
FIG. 3 is an exploded view, in perspective, of the auxiliary chain assembly shown in FIGS. 1 and 2.

Referring to FIG. 3, the auxiliary chain assembly 24 includes a support bracket 28 that has a generally U-shaped cross section, as viewed from the top, to form a rear plate portion 28*a* and side plate portions 28*b*, 28*c* and holes 30 formed within the side plate portions. A shaft 32 having a generally hexagonal cross section is provided with annular grooves at the ends of the shaft. Other non-circular cross-sections can be used for the shaft 32, such as square. The shaft 32 extends through the support bracket 28 and suitable bushings 34 and bearings 36 are provided to reduce friction. Retaining rings 38 receivable within the annular grooves maintain the components associated with the shaft 32 in place when the unit is assembled. A hand chain wheel 40 is positioned between the two side wall portions 28*b*, 28*c* arranged to be coupled to and rotate with the shaft 32 when a hand chain 42 is pulled to rotate the wheel 40 in one or the opposite direction. Advantageously, a chain guard 44 is provided that includes a flat portion 44*a* and two loop portions 44*b*, 44*c* that serve as guards and retain the chain in place on the wheel 40. Screws 46 secure the chain guard 44 to the side plate portion 28*b*.

An important feature of the invention is the provision of a stop brake assembly 48 secured to the side plate portion 28*c* in any conventional manner. The brake assembly 48 is also mounted on the hexagonal shaft 32, for reasons to be described. The hexagonal shaft 32 extends through the stop brake assembly 48 and is coupled to a chain gear 50, also mounted on the hexagonal shaft 32 for rotation therewith. The chain gear 50 is coupled to the chain 26 shown in FIGS. 1 and 2. A bushing 52 and bearing 54 are secured on the hexagonal shaft 32 by means of a retaining ring 56 received within the annular groove 32*b*.

Figure 4:
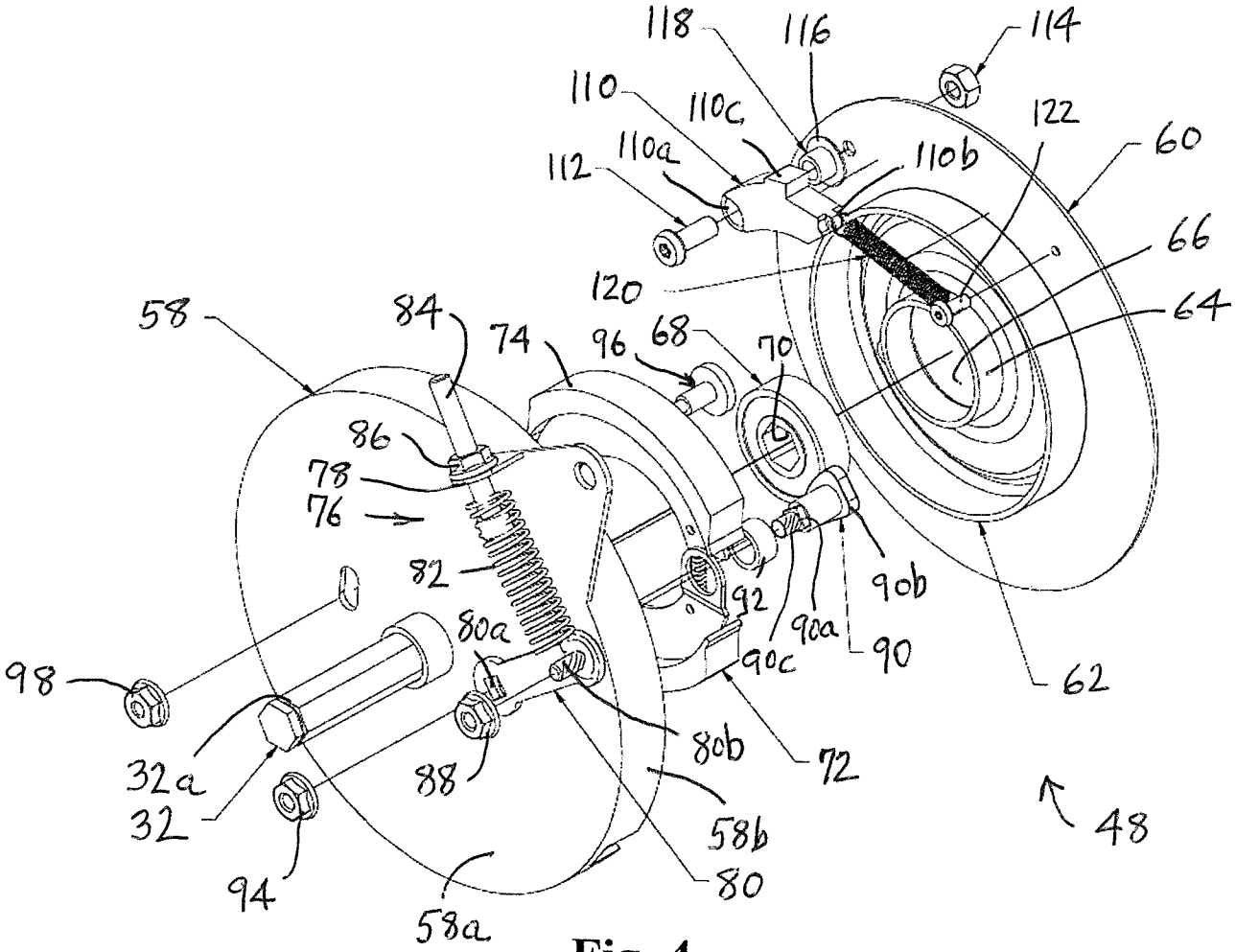
FIG. 4 is an exploded view, in perspective, of the brake assembly shown in FIG. 3.
Figure 5:
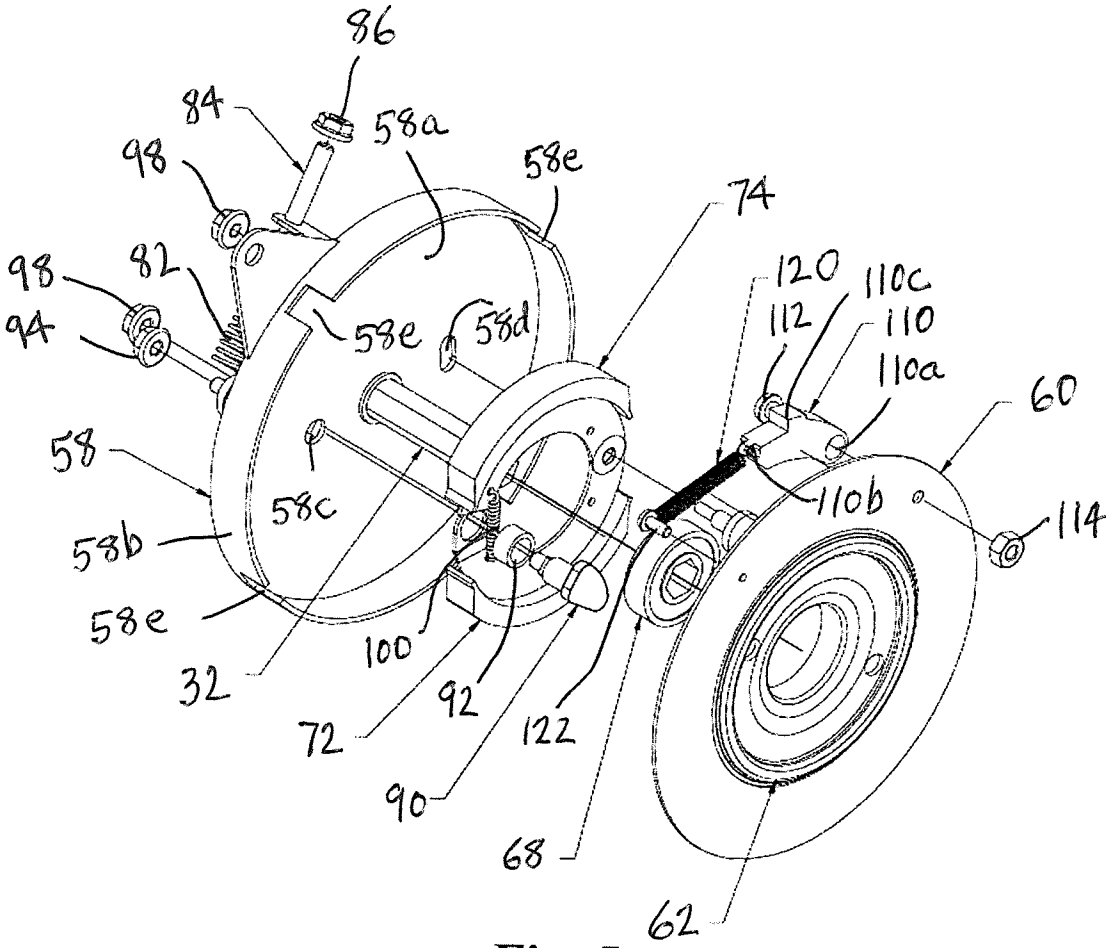
FIG. 5 is similar to FIG. 4 but showing the brake assembly from another perspective view.
Figure 6:
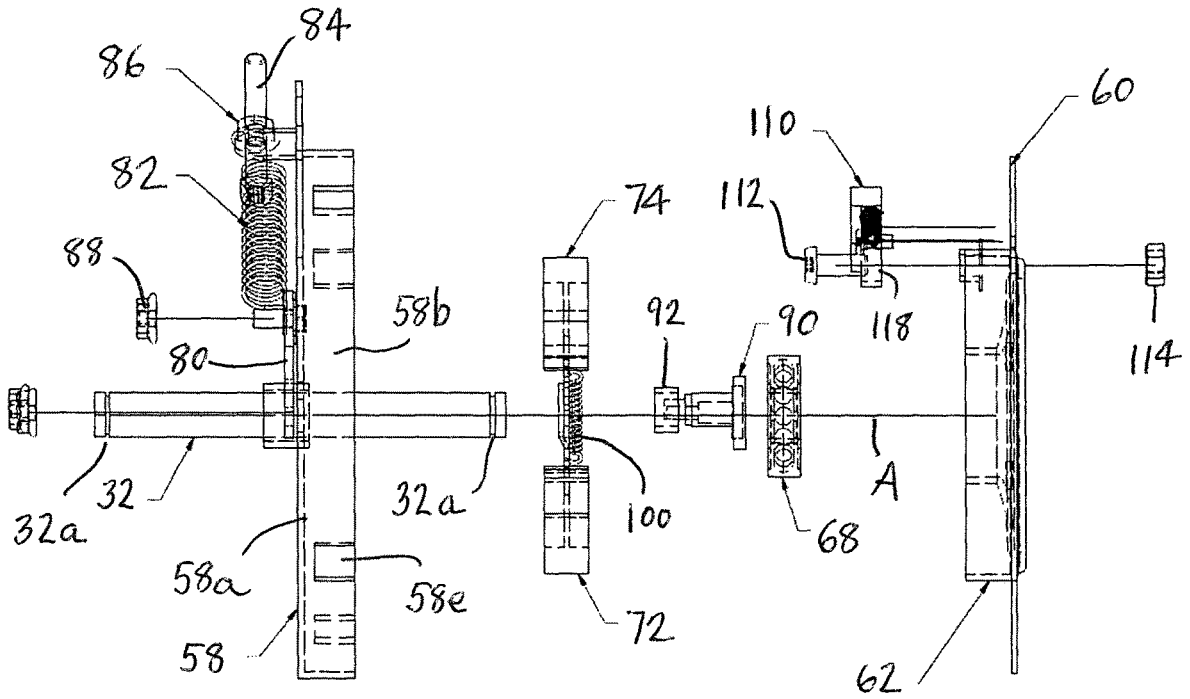
FIG. 6 is an exploded side elevational view of the stop brake assembly as shown in FIGS. 4 and 5.
Figure 7:
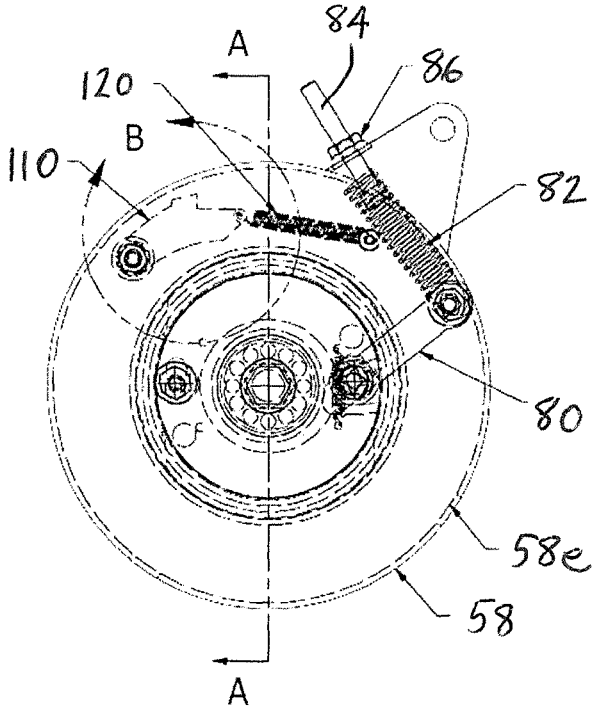
FIG. 7 is a front elevational view of the stop brake assembly.
Figure 8:
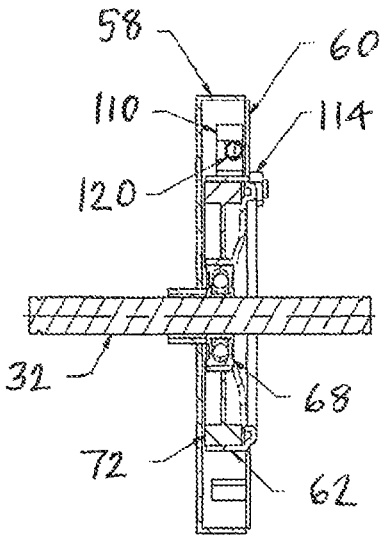
FIG. 8 is a cross-sectional view of the brake assembly shown in FIG. 7, taken along line A-A.
Figure 9:
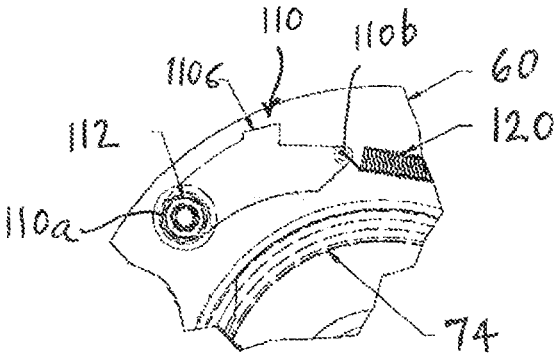
FIG. 9 is an enlarged view of detail B shown in FIG. 7.
Figure 10:
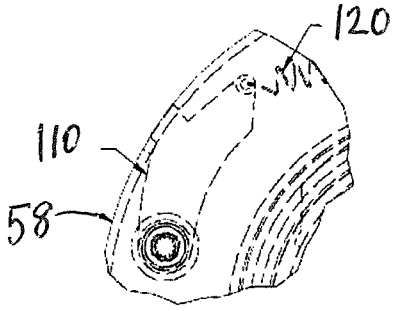
FIG. 10 is a fragmented view similar to the one shown in FIG. 9, showing engagement by the fly lockout pin or governor in an opening or notch in the housing or lock out retaining plate when the pin or governor reaches a predetermined angular velocity.

Referring to FIGS. 4-6, the brake assembly 48 includes a fixed brake tension adjustor housing 58 formed of a transverse circular plate portion 58*a* and a cylindrical portion 58*b*, and apertures 58*c*, 58*d* (FIG. 5) for fasteners. The cylindrical portion 58*b* is provided with spaced notches or cutouts 58*e*, to be more fully discussed below. Cooperating with the adjusting housing 58 is a retaining cover plate 60 to which a brake drum 62 is secured, such as by welding, best shown in FIG. 4. A retainer ring 64 is fixed on the retaining cover plate arranged co-axially with the brake drum 62 for receiving a one-way bearing 68 that includes an hexagonal opening or channel 70 on the inner race of the bearing for receiving the hexagonal shaft 32 while the outer race is fixed, such as by press fit, to the bearing retainer ring 64.

Positioned within the brake drum 62 are two brake shoes 72, 74 pivotally mounted to apply more or less friction against the internal surface of the brake drum 62, as will be more fully discussed.

Referring primarily to FIGS. 4 and 6, the adjustor housing 58 is provided with a brake tension adjustor generally designated by the reference numeral 76. A tab 78 supports a brake adjustor arm 80 provided with a rectangular hole 80*a* at one end and a threaded stem or pin 80*b* at the other end. A tension spring 82 is connected to the threaded stem or pin 80*b* at one end and to a threaded tensioning member 84 at the other end. A nut 88 secures the tension spring 82 at one end and can be rotated about the tensioning member 84 to stretch the spring 82 more or less and, thereby, adjust the tension applied to the threaded stem or pin 80*b*. Inside the housing 58 there is provided an adjustor cam 90 that is formed with a rectangular feature 90*a* and a generally triangular cam 90*b* formed with peaks having radial dimensions that are greater than flats about its periphery. A threaded cam stem 90*c* attaches the adjuster cam 90 to the brake tension housing 58 when the rectangular feature 90*a* is received within corresponding rectangular hole 80*a* of the brake adjustor arm 80. It will be clear that when the brake adjustor arm 80 rotates this causes corresponding rotation of the adjustor cam 90. A bushing 92 and a nut 94 secure the adjustor cam 90 and allows it to rotate freely in response to movements of the brake adjustor arm 80. Any suitable pin or threaded fastener 96 can be used to serve as a pivot pin for the brake shoes 72, 74 and for connecting the brake shoes to the housing 58 by means of a nut 98.

A tension spring 100 applies a force on the brake shoes 72, 74 to keep them in a retracted condition to reduce the friction applied by the brake shoes to the brake drum 62.

An optional feature is the provision of a fly lock out pin governor 110 provided with a smooth bore or hole 110*a* at one end and a spring retainer 110*b* at the other end. A rectangular protrusion projects outwardly between the two ends as shown. A bolt 112 extends through the hole 110*a* secured to a nut 114 to form a pivot about which the governor 110 can rotate. A lock washer 116 and a bushing 118 made from, for example, from bronze ensure that the governor 110 can rotate freely in response to centrifugal forces applied thereto upon excessive rotation of the retainer cover plate 60. A speed stop retainer tension spring 120 is applied between the spring retainer 110*b* and fixed pin or rivet 122 secured to the retainer plate 60. It will be clear that when the retaining cover plate 60 rotates above a predetermined speed the governor or fly lockout pin 110 rotates in a counter clockwise direction, as viewed in FIG. 4, against the tension of the spring 120.

Referring to FIGS. 7-10, the operation of the governor 10 is illustrated. When stationary or at slow rotational speeds the tension spring 120 retains the governor 110 in a retracted condition to prevent contact between the governor and the cylindrical plate portion 58*b*. However, when a predetermined or desired speed is reached the centrifugal force acting on the governor causes same to move to an extended position, shown in FIG. 10, in which the protrusion 110*c* is received within one of the notches or cutouts 58*e* causing the retainer plate 60 to come to an immediate stop and, when this occurs, the hexagonal shaft 32 is also stopped as is the chain gear 50. When the chain gear 50 is arrested and prevented from movement the chain 26 is likewise stopped and this causes the gear 22 and the main shaft 60 for the curtain 12 to stop as well. This, then, prevents the curtain from dropping further.

Figure 11:
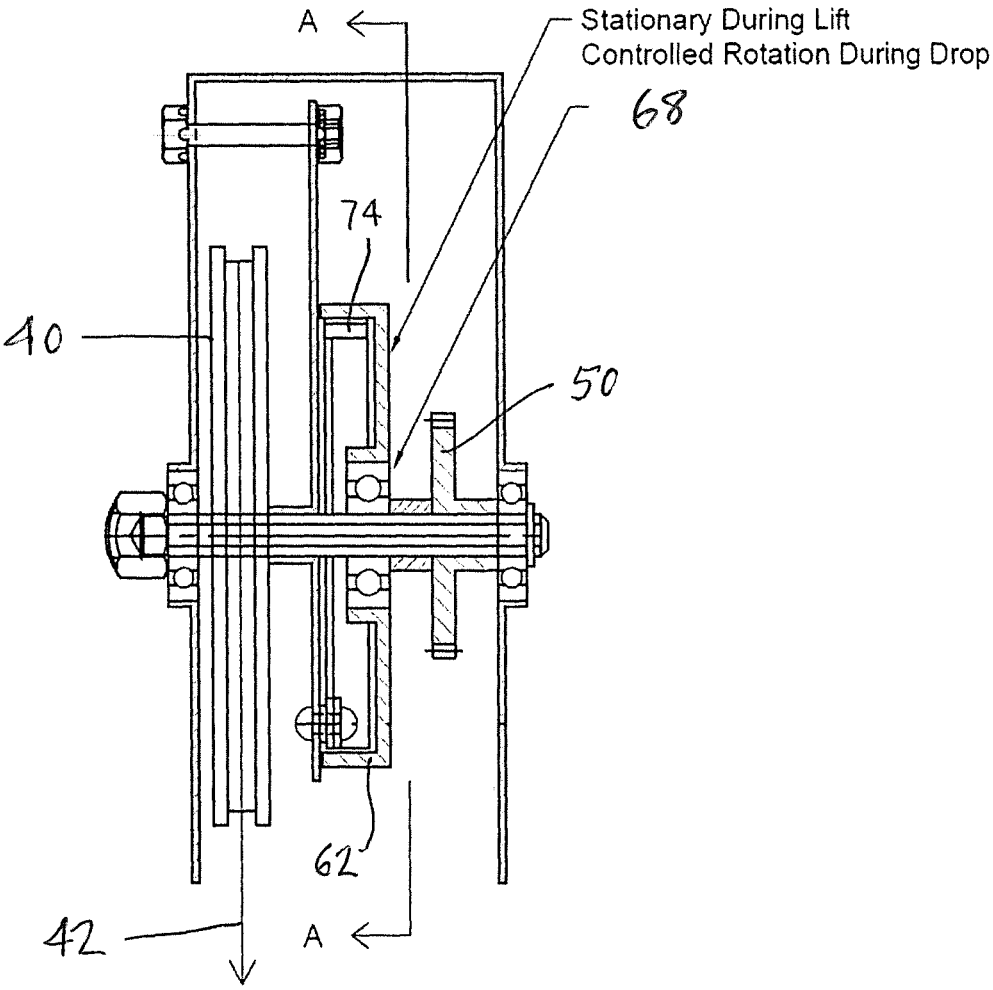
FIG. 11 is a similar view to FIG. 8 but shows additional components of the chain assembly.
Figure 12:
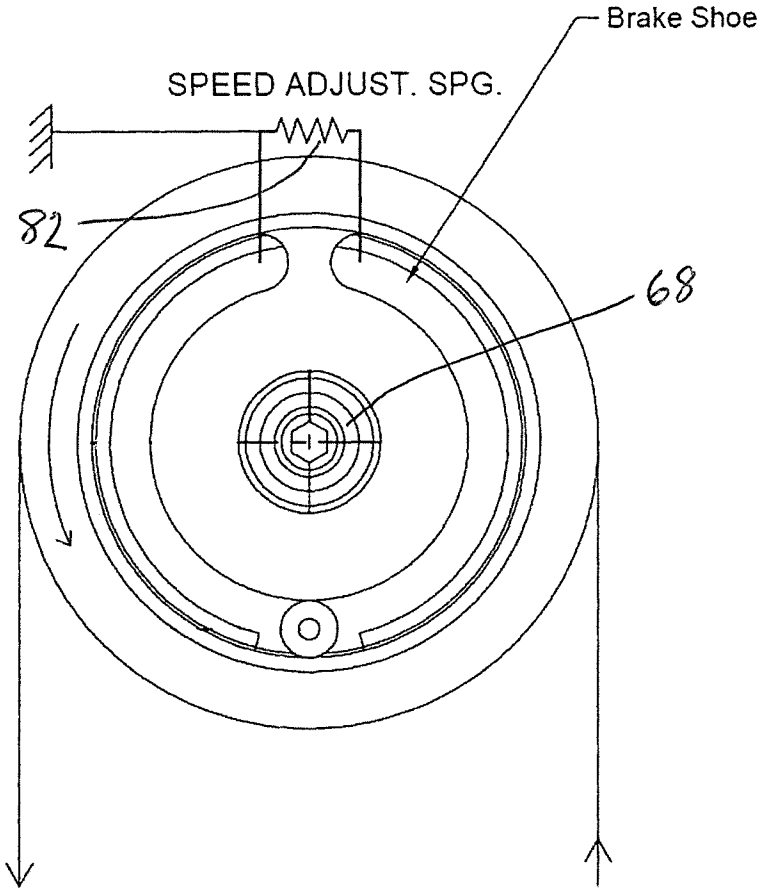
FIG. 12 is a diagrammatic view of the speed control brake assembly shown in FIG. 11 showing the brake drum and brake shoes and the speed adjusting spring.

Referring to FIGS. 11 and 12, the spring 82 is tensioned by means of the adjuster nut 86 to provide a desired friction between the brake shoes 72, 74 and the brake drum 62, this typically being a function of the weight of the rolling door and desired speed of descent. Tensioning of the spring 82 causes rotation of the adjustor cam 90 that applies a variable braking force to the brake shoes 72, 74 to cause the brake shoes to expand inside the brake drum to apply adjustable or variable braking forces on the brake drum.

Figure 13:
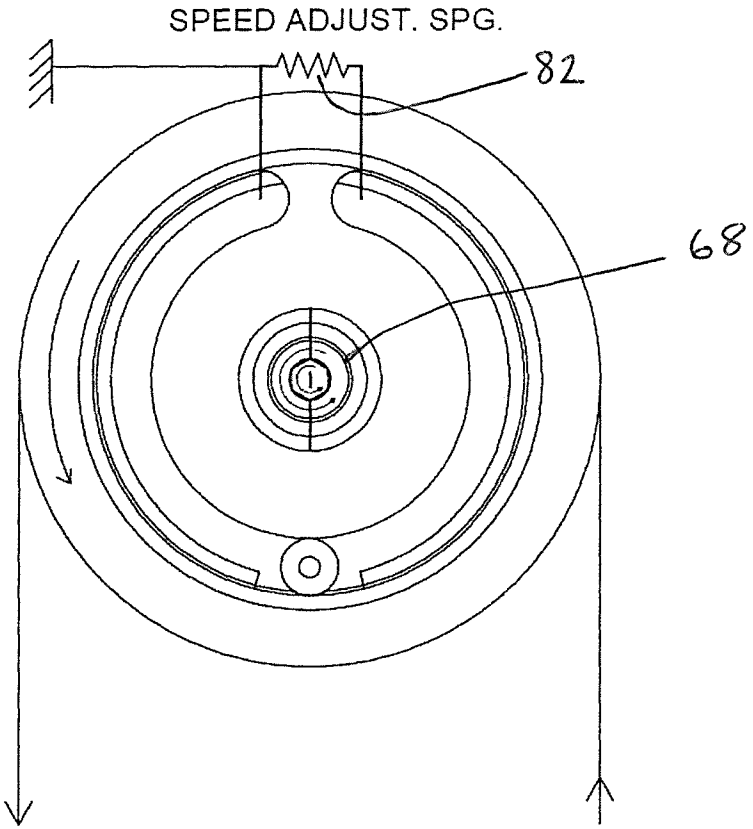
FIG. 13 is similar to FIG. 12 showing the brake drum stationary, such as when lifting a rolling door.

With the one way bearing 68 the outer race is fixed or secured to the bearing retainer ring 64 while the inner race is locked to the hexagonal shaft 32. The outer race rotates with rotations of the retainer plate 60. In FIG. 13, the one way bearing is arranged so that when a rolling door, for example, is being lifted and the hand chain wheel 40 is rotated in a counter clockwise direction, as viewed in FIG. 13, the inner race of the one way bearing 68 is free to rotate in relation to the stationary outer race and the brake drum 62, thus producing no friction with the brake shoes 72, 74. This allows the wheel 40 to rotate the hexagonal shaft 32 with no resistance from the brake assembly 48 to lift the curtain 12.

Figure 14:
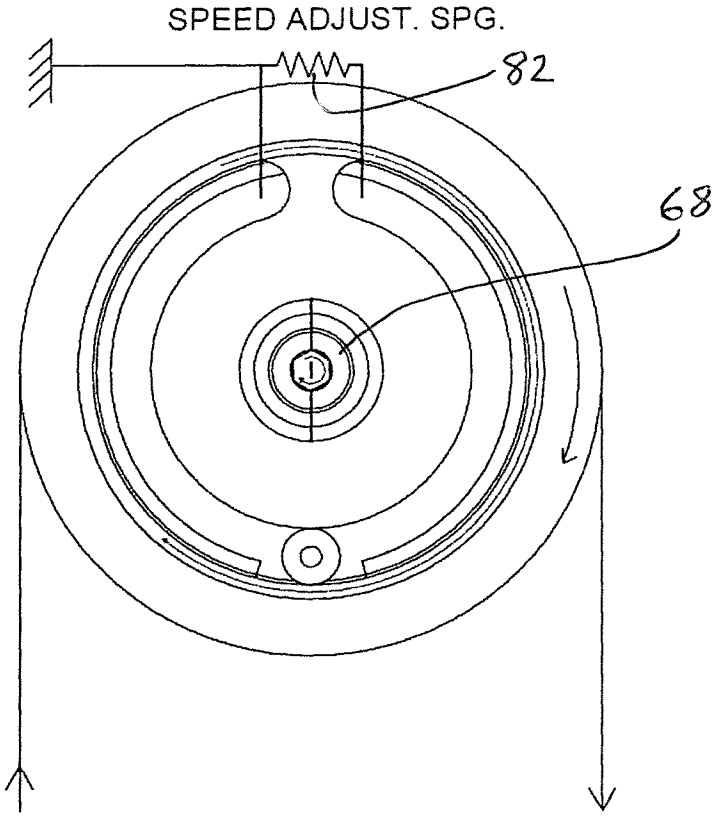
FIG. 14 is similar to FIG. 13, but showing the condition when the brake drum rotates in a clockwise direction, such as during a lowering or dropping of a rolling door.

Referring to FIG. 14 when the wheel 40 is rotated in a clockwise direction the inner and outer races of the one way bearing 68 are locked, causing the brake drum 62 to rotate in relation to the brake shoes 72, 74 to apply controlled braking forces on the brake drum 62 and in turn, on the hexagonal shaft 32 and the main shaft 16.

As will be appreciated, the chain assembly 24 is simple in construction and can be readily and efficiently used with a rolling door to control or regulate the speed at which a door is raised or lowered. With the optional governor or fly lock out pin the unit can also stop a rolling door from free fall thus avoiding potential injury or harm or damage to property.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A chain assembly comprising a shaft defining an axis; a hand operated chain wheel coupled to said shaft for rotating said shaft about said axis; a chain engaged with said chain wheel for rotating said shaft about said axis in one of first and second directions, said shaft being mounted for rotation in both said first and second directions; a one way bearing having an inner race secured to said shaft for rotation therewith and having an outer race that can freely rotate in one direction in relation to said inner race and prevented from freely rotating in another or opposite direction in relation to said inner race; a brake drum coupled to said outer race; a brake shoe in operative contact with said brake drum for applying frictional forces to said brake drum only when there is relative movement between said brake shoe and said brake drum with rotation of said chain wheel in only said second direction; brake adjusting means for adjusting the braking forces applied by said brake shoe on said brake drum, said one way bearing being arranged to maintain said brake drum stationary in relation to said brake shoe in said first direction of rotation of said shaft and to move in relation to said brake drum in said second direction of rotation of said shaft resulting in a degree of braking of said shaft as determined by said brake adjusting means, whereby said shaft can be continuously rotated in both said first and second directions with retarding forces applied to said shaft only when said shaft is rotated in said second direction.

2. The chain assembly as defined in claim 1, wherein said shaft has a hexagonal cross-section and said wheel and said inner race have a mating hexagonal opening to receive said shaft.

3. The chain assembly as defined in claim 1, wherein said brake shoe is pivotally mounted for movements in relation to said brake drum.

4. The chain assembly as defined in claim 1, further comprising a housing having an opening for said shaft, said brake shoe being fixed on an inside surface of said housing.

5. The chain assembly as defined in claim 4, wherein said brake adjusting means is mounted on an outside surface of said housing.

6. The chain assembly as defined in claim 5, wherein said brake adjusting means includes a cam for applying variable pressure or force on said brake shoe upon rotation of said cam.

7. The chain assembly as defined in claim 6, wherein said brake adjusting means comprises a spring tensioning means mounted on the outside surface of said housing and coupled to said cam, whereby said spring tensioning means can be adjusted outside of said housing to accommodate angular forces applied to said shaft.

8. A rolling door chain assembly comprising a main horizontal shaft; a curtain of linked horizontal slats; a frame comprising vertical tracks or rails arranged to slidably receive lateral ends of said curtain slats, said curtain being moveable upwardly and downwardly within said frame; a chain assembly coupled to said main horizontal shaft, said chain assembly comprising an operator shaft defining an axis and coupled to said main horizontal shaft; a hand operated chain wheel coupled to said operator shaft for rotating said operator shaft about said axis; a chain engaged with said chain wheel for rotating said operator shaft about said axis in a first direction for upwardly raising said curtain and a second direction for downwardly lowering said curtain, said operator shaft being mounted for unlocked rotation in both said first and second directions; a one way bearing having an inner race secured to said operator shaft for rotation therewith and having an outer race that can freely rotate in one direction in relation to said inner race and prevented from freely rotating in another or opposite direction in relation to said inner race; a brake drum coupled to said outer race; a brake shoe in operative contact with said brake drum for applying frictional forces to said brake drum only when there is relative movement between said brake shoe and said brake drum with rotation of said chain wheel only in said second direction corresponding to the lowering of said curtain; brake adjusting means for adjusting the braking forces applied by said brake shoe on said brake drum, said one way bearing being arranged to maintain said brake drum stationary in relation to said brake shoe in said first direction of rotation of said operator shaft corresponding to upward movement of said curtain and to move in relation to said brake drum in said second direction of rotation of said operator shaft resulting in a degree of braking of said operator shaft as determined by said brake adjusting means, whereby said operator shaft can be continuously rotated in both said first and second directions with different degrees of braking applied to said operator shaft and said main horizontal shaft.

9. The rolling door chain assembly as defined in claim 8, wherein said hand operated chain wheel is mounted for rotation about said axis of said shaft.

10. A rolling door chain assembly as defined in claim 8, wherein said operator shaft has an hexagonal cross-section and said wheel and said inner race have mating hexagonal openings to receive said shaft.

11. A rolling door chain assembly as defined in claim 8, further comprising a housing having an opening for said operator shaft, said brake shoe being fixed on an inside surface of said housing.

12. A rolling door chain assembly as defined in claim 11, wherein said brake adjusting means is mounted on an outside surface of said housing.

13. A rolling door chain assembly as defined in claim 12, wherein said brake adjusting means includes a cam for applying variable pressure or force on said brake shoe upon rotation of said cam.

14. A rolling door chain assembly as defined in claim 13, wherein said brake adjusting means comprises a spring tensioning means mounted on the outside surface of said housing and coupled to said cam, whereby said spring tensioning means can be adjusted outside of said housing to accommodate angular forces applied to said shaft.

15. A rolling door chain assembly as defined in claim 8, further comprising governor means for arresting rotation of said operator and said main horizontal shafts when a predetermined speed of rotation is reached.

16. A rolling door chain assembly as defined in claim 15, wherein said brake drum is mounted on a retaining plate, and said governor means is also mounted on said retaining plate for sharing rotational movements with said brake drum.

17. A rolling door chain assembly comprising a main horizontal shaft; a curtain of linked horizontal slats; a frame comprising vertical tracks or rails arranged to slidably receive lateral ends of said curtain slats, said curtain being moveable upwardly and downwardly within said frame; a chain assembly coupled to said main horizontal shaft, said chain assembly comprising an operator shaft defining an axis and coupled to said main horizontal shaft; a hand operated chain wheel coupled to said operator shaft for rotating said operator shaft about said axis; a chain engaged with said chain wheel for unlocked rotation of said operator shaft about said axis in a first direction for upwardly raising said curtain and a second direction for downwardly lowering said curtain, said operator shaft being mounted for unlocked rotation in both said first and second directions provided that a speed of rotation is below a predetermined speed; a one way bearing having an inner race secured to said operator shaft for rotation therewith and having an outer race that can freely rotate in one direction in relation to said inner race and prevented from freely rotating in another or opposite direction in relation to said inner race; a brake drum coupled to said outer race; a brake shoe in operative contact with said brake drum for applying frictional forces to said brake drum only when there is relative movement between said brake shoe and said brake drum with rotation of said chain wheel only in said second direction corresponding to the lowering of said curtain; brake adjusting means for adjusting the braking forces applied by said brake shoe on said brake drum, said one way bearing being arranged to maintain said brake drum stationary in relation to said brake shoe in said first direction of rotation of said operator shaft corresponding to upward movement of said curtain and to move in relation to said brake drum in said second direction of rotation of said operator shaft resulting in a degree of braking of said operator shaft as determined by said brake adjusting means, whereby said operator shaft can be continuously rotated in both said first and second directions as long as said operator shaft rotating speed does not exceed said predetermined speed.

18. The rolling door chain assembly as defined in claim 17, further comprising governor means for adjustably setting said predetermined speed.

19. The rolling door chain assembly as defined in claim 18, wherein said brake drum is mounted on a retaining plate, and said governor means is also mounted on said retaining plate for sharing rotational movements with said brake drum.

20. The rolling door chain assembly as defined in claim 18, wherein said governor means comprises a spring-loaded weight that is mounted to pivot between a first position allowing said shaft to rotate when said shaft rotates below said predetermined speed and a second position that locks said shaft when said shaft exceeds said predetermined speed.

* * * * *